US005451265A

United States Patent [19]

Koshinen et al.

[11] Patent Number: 5,451,265

[45] Date of Patent: Sep. 19, 1995

[54] METHOD AND APPARATUS FOR USE IN THE PRESS OR DRYER SECTION OF A PAPER MACHINE OR SIMILAR EQUIPMENT

[75] Inventors: Pekka Koshinen, Kotka; Timo Haverinen, Masku, both of Finland

[73] Assignee: EV Group Oy, Kotka, Finland

[21] Appl. No.: 145,408

[22] Filed: Oct. 29, 1993

[30] Foreign Application Priority Data

May 27, 1993 [FI] Finland ..... 932434

[51] Int. Cl.[6] ..... B08B 9/00; B08B 9/04; B08B 9/093; B08B 3/02

[52] U.S. Cl. ..... 134/8; 134/22.1; 134/22.12; 134/22.18; 134/24; 134/37; 134/42

[58] Field of Search ..... 134/8, 22.1, 22.12, 134/22.18, 24, 37, 42

[56] References Cited

U.S. PATENT DOCUMENTS 3,617,441 11/1971 Farrell ..... 162/199
4,516,330 5/1985 Eskelinen et al. ..... 34/23
4,683,027 7/1987 Pitkäjärvi ..... 162/199

FOREIGN PATENT DOCUMENTS 65460 1/1984 Finland .

*Primary Examiner*—David A. Simmons
*Assistant Examiner*—Zeinab El-Arini
*Attorney, Agent, or Firm*—Lorusso & Loud

[57] ABSTRACT

A method for cleaning one or more orifice slots (2, 3) of a blow box (1) or similar object particularly in the press or dryer section of a paper machine or similar equipment. The orifice slot (2, 3) is subjected to treatment from inside the blow box by means of one or more mechanical cleaning elements (4) and/or a cleaning jet (8, 9, 23). The invention also concerns an apparatus suited for implementing said method.

12 Claims, 3 Drawing Sheets

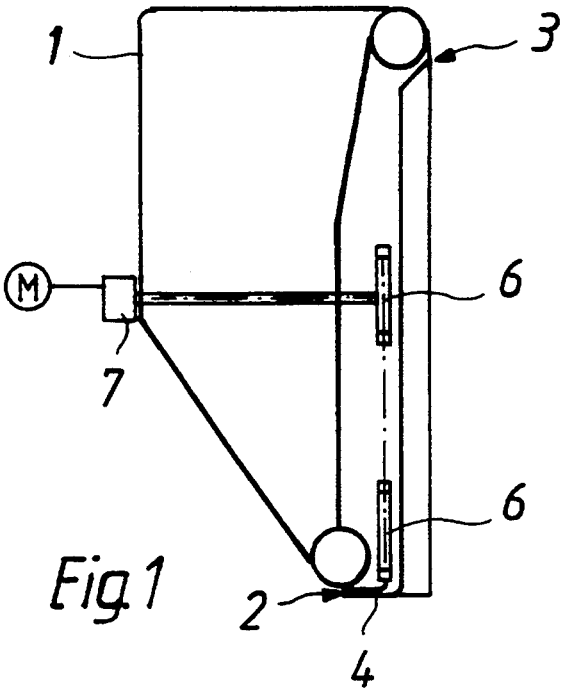
Fig. 1
Fig. 3
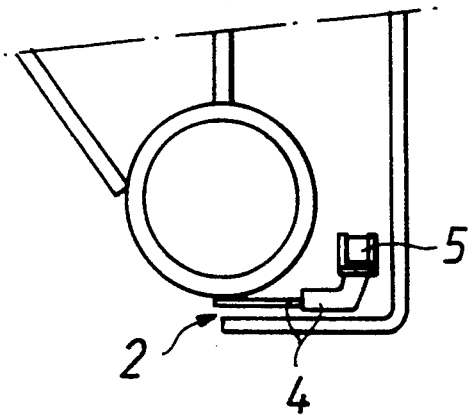
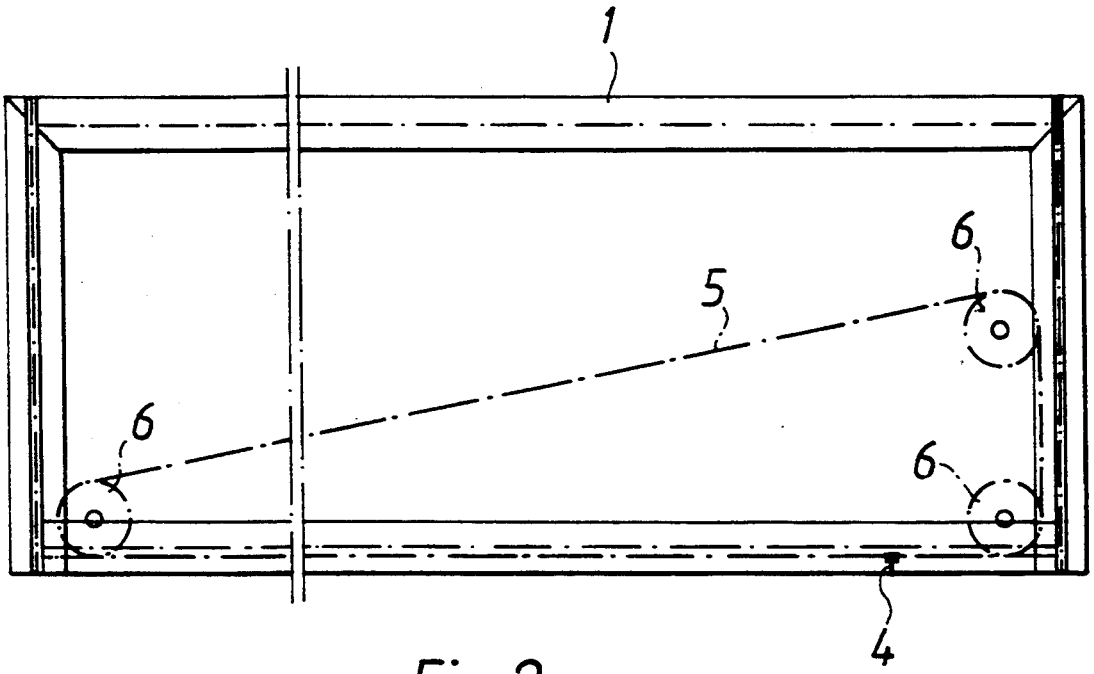
Fig. 2

METHOD AND APPARATUS FOR USE IN THE PRESS OR DRYER SECTION OF A PAPER MACHINE OR SIMILAR EQUIPMENT

FIELD OF INVENTION

The invention relates to a method intended for applications in a paper machine or similar equipment, particularly for cleaning orifice slots or similar objects in the blow boxes or similar units of the press or dryer sections.

Further, the invention concerns an apparatus implementing said method according to the invention for cleaning the orifice slots of a blow box.

BACKGROUND OF THE INVENTION

Paper and board machines conventionally use blow boxes within the single-wire region for supporting the web. Such apparatuses are described in FI laid-open publication 69332 and FI laid-open publication 65460.

Air to the blow boxes is generally taken as recycle air from inside the hood of a paper machine or similar equipment. The recycle air is contaminated by, e.g., dust whose landing into the blow box clogs the orifice slots of the blow box at least partially, thereby worsening the efficiency of the box. Impairment of the box function causes web instability such as flutter, whereby the frequency of web breaks and other malfunctions increases. Obviously, such problems result in decrease of production output and profitability at the paper machine or similar equipment.

It is an object of the present invention to achieve a method capable of overcoming the problems associated with the clogging of the blow boxes. A further object is to attain apparatus implementing said method, suited for rapid and easy cleaning of the orifice slots.

SUMMARY OF THE INVENTION

The invention is based on cleaning the slots of the blow box from inside the blow box using means adapted to the inside of the box.

More specifically, the invention is characterized by what is stated in the characterizing part of claim 1.

Furthermore, the apparatus implementing the method is characterized by what is stated in the characterizing part of claim 5.

The invention offers several important benefits. The orifice slot of the blow box can be cleaned rapidly and easily. Thus, the clogging of the slots is avoided, whereby the web can be run stably and with less risk of web breaks. By arranging the cleaning means movable, a simple and effective system for cleaning the orifice slot is attained. Implementing the cleaning means by way of a cleaning jet nozzle from which the cleaning solution is ejected at elevated pressure, the cleaning efficiency can be further improved. A tilted orientation of the cleaning jet nozzle or the orifice holes of the nozzle provides an advantageous and fail-safe transfer arrangement of the nozzle head.

BRIEF DESCRIPTION OF THE DRAWING

In the following the invention is examined in greater detail by way of advantageous exemplifying embodiments with reference to the annexed drawings in which FIG. 1 shows a side view of a blow box in which the method according to the invention is implemented for cleaning an orifice slot by means of a mechanical cleaning element, FIG. 2 shows the blow box illustrated in FIG. 1 with the bottom plate removed, FIG. 3 shows a detail of the blow box illustrated in FIG. 1.

DESCRIPTION OF THE PREFERRED EMBODIMENT

Figure 6:
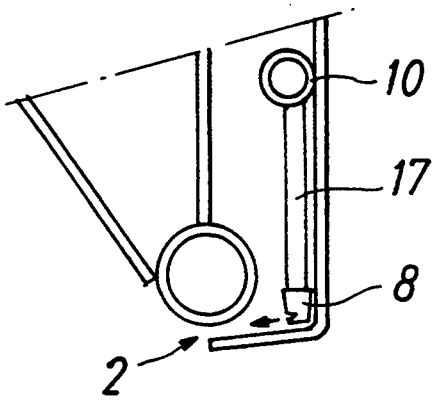
FIG. 6 shows an alternative embodiment of the arrangement illustrated in FIG. 4.

With reference to FIG. 1, a blow box 1 employed in the press or dryer section of a paper machine or similar equipment is shown in partially sectional side view. The blow box 1 has two orifice slots 2, 3, which are advantageously aligned perpendicular to the web machine direction extending advantageously over the entire width of the web, and a manifold for routing the blowing air into the slots. The orifice slot 2 is provided with a mechanical cleaning element 4 which is moved over the longitudinal direction of the orifice slot 2 by means of a drive machinery 5, 6, 7. The drive machinery is comprised of one or more, advantageously three, drive wheels, for instance chain sprockets 6, and a drive chain 5 or similar means routed through the drive wheel set. The cleaning element 4 is arranged movable along with the drive chain 5 or equivalent means as shown in FIG. 3. A drive actuator such as an electric motor 7 is arranged to rotate the drive wheels 6 via, e.g., a shaft. The motor can also be of a reversible type, thus permitting a reciprocating movement of the cleaning element in the orifice slot. The cleaning element 4 is advantageously a peg with a diameter of 1–5 mm for instance, advantageously 2 mm. The drive machinery can be interlocked with the automatic web break control system of the paper machine or equivalent equipment, whereby the cleaning sequence can be run automatically during a web break.

Figure 4:
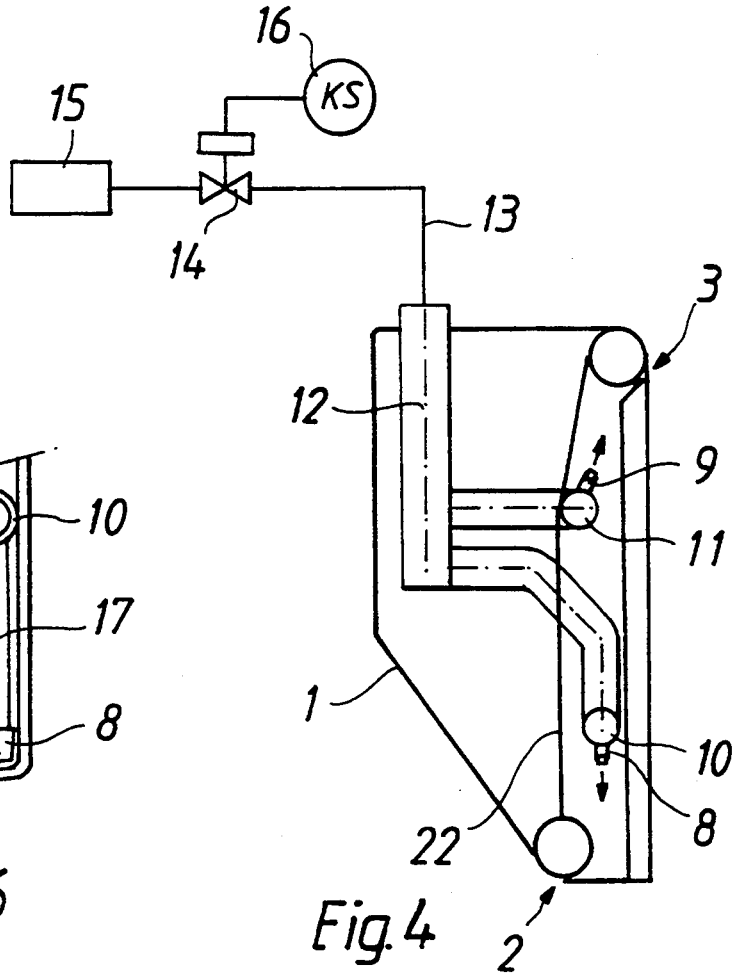
FIG. 4 shows a side view of a blow box in which the method according to the invention is implemented by way of fixed cleaning jets for cleaning an orifice jet.
Figure 5:
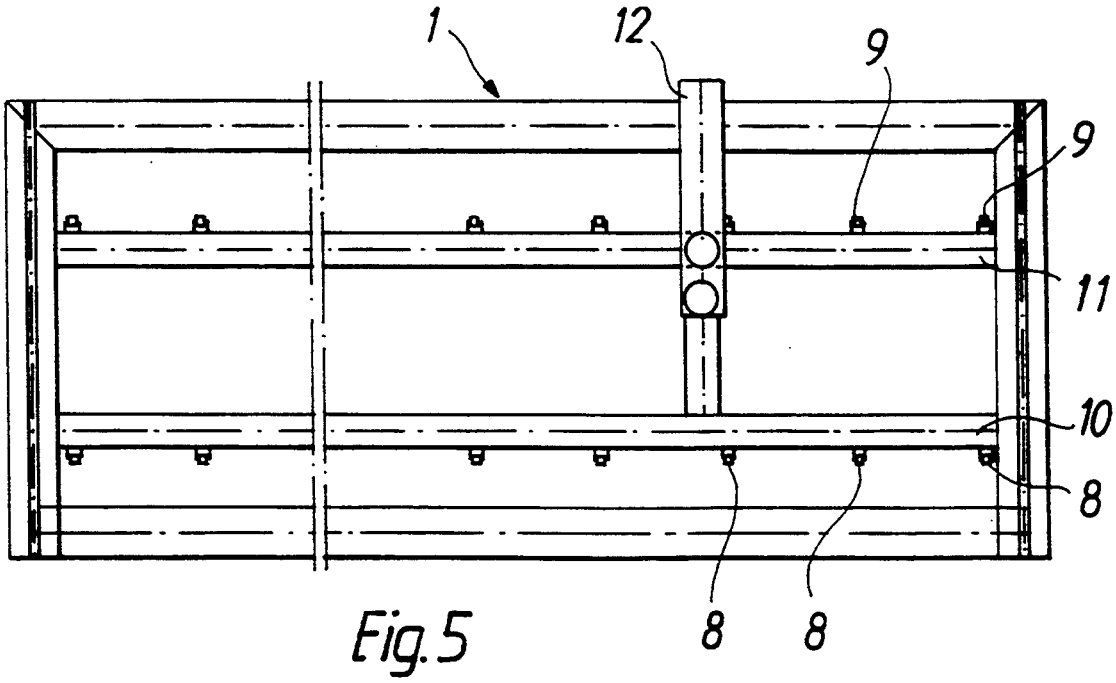
FIG. 5 shows the blow box illustrated in FIG. 4 with the bottom plate removed.

FIG. 4 shows a blow box 1 arranged to have several fixed cleaning jet nozzles 8, 9 for cleaning orifice slots 2, 3. The intermediate chamber 22 of the blow box 1 is adapted to incorporate one or more pipes 10, 11 into which a liquid and/or gaseous cleaning medium or a mixture thereof is routed. The cleaning jet nozzles 8, 9 are mounted to the pipes 10, 11 so that the orifice holes of the nozzle are advantageously aligned toward the orifice slots 2, 3 of the blow box. The pipes 10, 11 have a length advantageously extending over essentially the entire length of the blow box. The cleaning jet nozzles 8, 9 are mounted to the pipes 10, 11 at a spacing of approx. 4–10 pcs./meter. The nozzles 8, 9 are arranged into the blow box 1 in a manner permitting the cleaning medium jets exiting from the nozzles to cover essentially the entire area of the orifice slot 2, 3. In an advantageous embodiment an intermediate pipe 17 is adapted between the pipe 10 and the nozzle 8, whereby the nozzles 8 can be brought closer to the orifice slot 2. Then, the cleaning medium jet is aligned directly toward the orifice slot 2.

When necessary, the pipes 10, 11 can be connected in the interior of the blow box to the pipe 12 which is further connected via a pipe 13 to the piping network running outside the blow box 1. The inlet pipe to the cleaning system is advantageously provided with a filter element 15 for removal of impurities from the cleaning jet. The filter element 15 is advantageously a microporous filter with a pore size of 200–500 μm typical. The inlet pipe 13 is also equipped with a stop/control element 14, which with the help of a control means such as a timer controller 16 directs the cleaning medium into one blow box at a time. The stop/control element 14 is advantageously a solenoid valve. The cleaning medium is pumped with the help of a pump (not shown in the diagrams) into the plant piping network.

Figure 7:
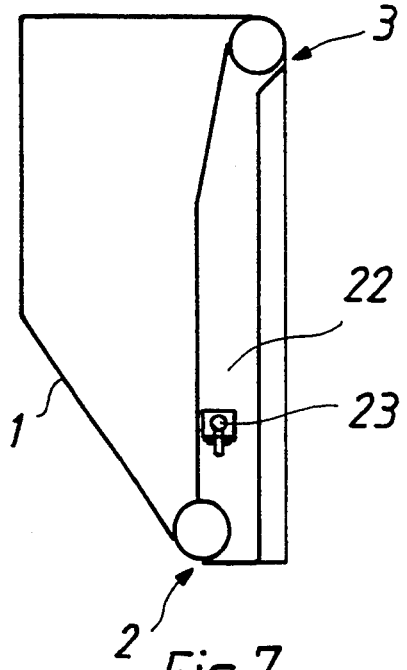
FIG. 7 shows a blow box in which the method according to the invention is implemented for cleaning an orifice slot by way of a moving cleaning jet.
Figure 9:
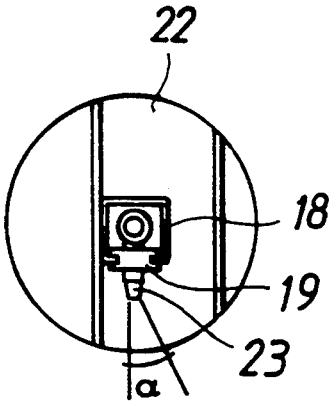
FIG. 9 shows a detail of the blow box illustrated in FIG. 7.
Figure 8:
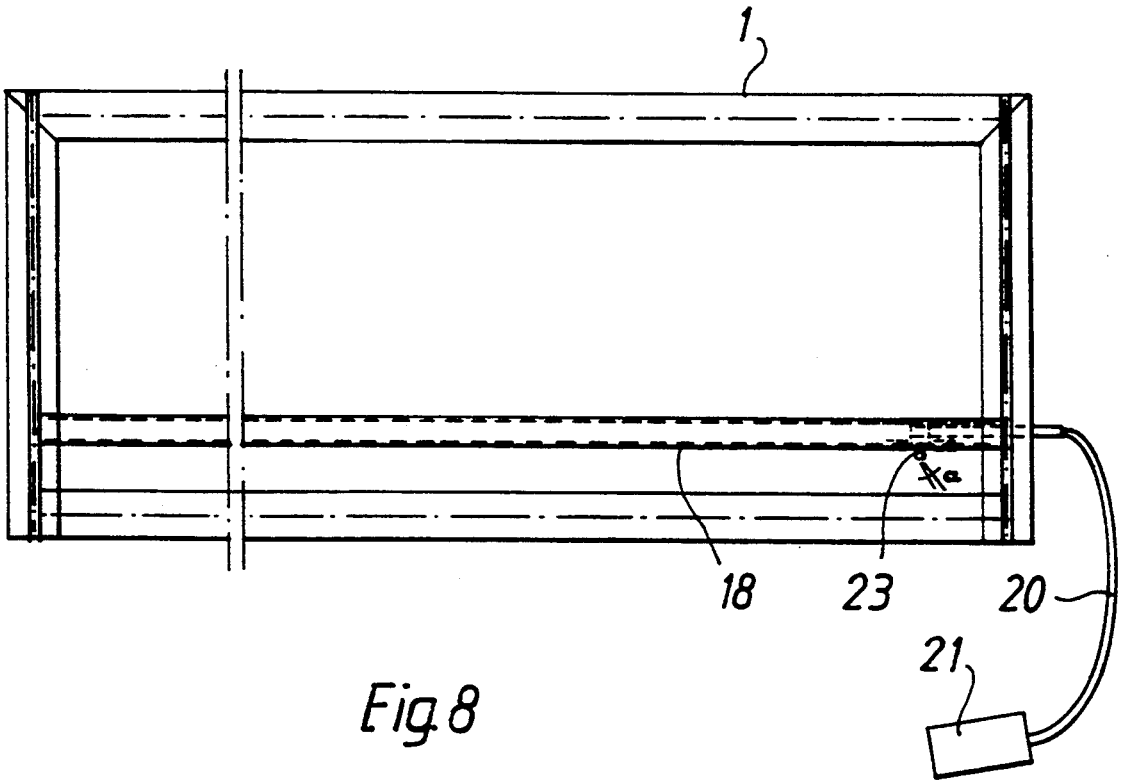
FIG. 8 shows the blow box illustrated in FIG. 7 with the bottom plate removed.

With reference to FIGS. 7, 8 and 9, another preferred embodiment is shown in which the intermediate chamber 22 of the blow box 1 is provided with a control element 18 such as a guide rail having a width advantageously extending essentially over the entire blow box. The blow box 1, advantageously its end, is equipped with a sealable opening through which a cleaning nozzle 23 can be mounted to the interior of the blow box 1. The cleaning nozzle 23 is adapted onto a counter piece 19 such as a sliding carriage or equivalent, compatible with the guide element 18, whereby the counter piece 19 and the guide rail 18 are designed mutually compatible in a manner that permits moving the cleaning nozzle head 23 along the guide rail over the blow box from end to end. The cleaning nozzle 23, or alternatively, one or more of the nozzle orifices of the nozzle head are aligned at an angle $\alpha$, thereby causing the cleaning medium jet exiting the nozzle 23 to impart a reaction force which pushes the cleaning nozzle mounted on the control element along the guide rail 18. Thus, the orifice slot of the blow box can be entirely cleaned using only a single nozzle. The cleaning nozzle 23 is advantageously connected to a pump 21, advantageously a high-pressure cleaner or similar by way of a flexible hose 20 or equivalent means. The high-pressure cleaner 21 is advantageously operated at approx. 80–120 bar pressure. The high-pressure cleaner 21 is advantageously connected in a conventional manner to water piping. The benefit of this embodiment is therein that a single cleaning apparatus can be used in a number of blow boxes. The blow boxes only have to be designed with an opening for introducing the cleaning nozzle 23 into the blow box and the nozzle element must be provided with a control element 18.

For those versed in the art it is obvious that the invention is not limited to the exemplifying embodiments described above, but rather, can be varied within the scope of the annexed claims. Thus, the blow box can be provided with multiple cleaning elements operating in different principles.

What is claimed is:

1. A method for cleaning each orifice slot (2, 3) of a blow box (1) particularly in the press or dryer section of a paper machine, characterized in that the orifice slot (2, 3) is subjected to treatment by means of at least one mechanical cleaning element (4) disposed within the blow box.

2. The method of claim 1, wherein the mechanical cleaning element being used is a peg projecting into the orifice slot.

3. The method of claim 1, wherein the at least one mechanical cleaning element is longitudinally movable and in which said method further includes moving the at least one mechanical cleaning longitudinally in the orifice slot when the orifice slot is being treated.

4. A method for cleaning each orifice slot (2, 3) of a blow box (1) particularly in the press or dryer section of a paper machine, characterized in that the orifice slot (2, 3) is subjected to treatment by means of at least one fluid cleaning jet (8, 9, 23) disposed within the blow box.

5. The method of claim 4, wherein the fluid cleaning jet is operated using a fluid ejected under pressure.

6. The method of claim 5, wherein the fluid being ejected is a liquid.

7. The method of claim 5, wherein the fluid being ejected is a gaseous medium.

8. The method of claim 5, wherein the fluid being ejected is a gaseous medium and a liquid mixture.

9. The method of claim 4, wherein the at least one fluid cleaning jet is longitudinally movable and in which said method further includes moving the at least one fluid cleaning jet longitudinally in the orifice slot when the orifice slot is being treated.

10. The method of claim 9, characterized in that the moving force for said cleaning jet (8, 9, 23) is attained by tilting at least a part of the jet.

11. The method of claim 9, characterized in that the moving force for said cleaning jet (8, 9, 23) is attained by tilting the jet.

12. A method for cleaning each orifice slot (2, 3) of a blow box (1) particularly in the press or dryer section of a paper machine, characterized in that the orifice slot (2, 3) is subjected to treatment by means of at least one mechanical cleaning element (4) and at least one fluid cleaning jet (8, 9, 23) both of which being disposed within the blow box.

* * * * *

UNITED STATES PATENT AND TRADEMARK OFFICE

CERTIFICATE OF CORRECTION

PATENT NO. : 5,451,265

DATED : September 19, 1995

INVENTOR(S) : Koskinen et al.

It is certified that error appears in the above-indentified patent and that said Letters Patent is hereby corrected as shown below:

On title page, item [19], delete "Koshinen, et al." should read —Koskinen— item [75] delete "Koshinen" and insert —Koskinen—

Signed and Sealed this

Twenty-seventh Day of February, 1996

*Attest:*

Bruce Lehman

BRUCE LEHMAN

*Attesting Officer*

*Commissioner of Patents and Trademarks*